US007853412B2

(12) United States Patent
Xia et al.

(10) Patent No.: US 7,853,412 B2
(45) Date of Patent: Dec. 14, 2010

(54) ESTIMATION OF WHEEL RAIL INTERACTION FORCES

(75) Inventors: Fujie Xia, Rockhampton (AU); Peter Joseph Wolfs, Rockhampton (AU)

(73) Assignees: QR Limited, Brisbane (AU); Australian Rail Track Corporation Ltd, Sydney (AU); Pacific National (Victoria) Ltd, Melbourne (AU); Asciano Services Pty Ltd, Melbourne (AU); TMG Rail Technology Pty Ltd, Sydney (AU); Rail Corporation NSW, Haymarket (AU); Central Queensland University, North Rockhampton (AU); University of Wollongong, New South Wales (AU); Monash University, Monash University (AU); University of South Australia, Adelaide (AU); Queensland University of Technology, Brisbane (AU); The University of Queensland, St. Lucia (AU)

( * ) Notice: Subject to any disclaimer, the term of this patent is extended or adjusted under 35 U.S.C. 154(b) by 0 days.

(21) Appl. No.: 11/916,636

(22) PCT Filed: Jun. 8, 2006

(86) PCT No.: PCT/AU2006/000775

§ 371 (c)(1),
(2), (4) Date: Oct. 31, 2008

(87) PCT Pub. No.: WO2006/130908

PCT Pub. Date: Dec. 14, 2006

(65) Prior Publication Data

US 2009/0076742 A1 Mar. 19, 2009

(30) Foreign Application Priority Data

Jun. 8, 2005 (AU) ..... 2005902966

(51) Int. Cl.
*G01L 3/00* (2006.01)
*G01P 15/00* (2006.01)

(52) U.S. Cl. ..... 702/41; 702/141

(58) Field of Classification Search ..... 702/41, 702/141; 701/37, 38
See application file for complete search history.

(56) References Cited

U.S. PATENT DOCUMENTS 5,433,111 A 7/1995 Hershey et al.

(Continued)

FOREIGN PATENT DOCUMENTS

| | | | |
|---|---|---|---|
| DE | 102004024951 | A1 | 12/2005 |
| EP | 1593572 | A1 | 11/2005 |
| FR | 2602479 | A | 8/1992 |
| GB | 2400442 | A | 10/2004 |

(Continued)

OTHER PUBLICATIONS

Garg et al., Dynamics of Railway Vehicle Systems, Academic Press, 1984, pp. 103-133.

*Primary Examiner*—Bryan Bui
(74) *Attorney, Agent, or Firm*—Seed IP Law Group PLLC

(57) ABSTRACT

A method of estimating contact forces between the wheels of a railway wagon and a rail track, for use in determining information such as the likelihood of derailment. Accelerations of the body of the wagon are measured using motion sensors located at suitable points on the body. Forces on the side frames of the wagon are calculated based on the accelerations of the body and predetermined parameters of the body. Forces on the wheels of the wagon are calculated based on the accelerations of the body and predetermined parameters of the body. The contact forces between the wheels and the rails are then calculated based on the forces calculated for the side frames and the wheels. The calculations are carried out using an inverse model of the wagon system. Equipment which implements the method is also described.

14 Claims, 8 Drawing Sheets

U.S. PATENT DOCUMENTS

Figure 1:
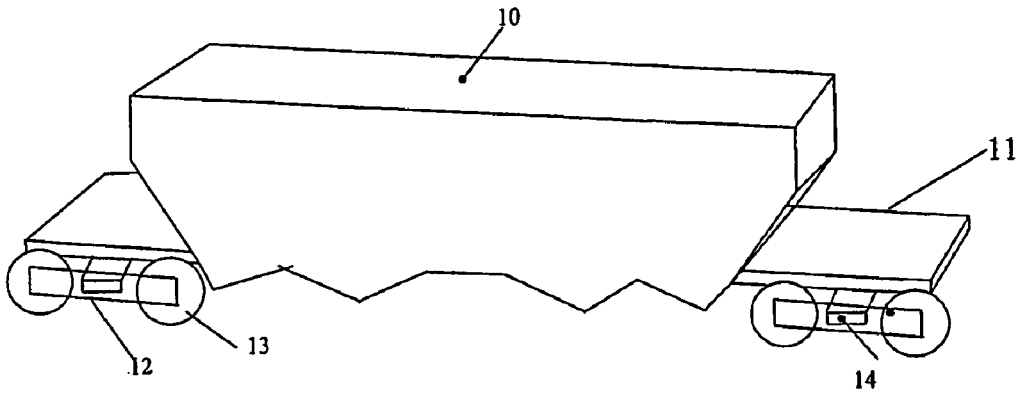

| | | | | |
|---|---|---|---|---|
| 5,579,013 | A | 11/1996 | Hershey et al. | |
| 5,924,654 | A | 7/1999 | Anderson | |
| 5,987,369 | A * | 11/1999 | Kwak et al. | 701/37 |
| 6,539,293 | B2 | 3/2003 | Bachtiger et al. | |
| 6,668,239 | B1 | 12/2003 | Gilbert et al. | |

FOREIGN PATENT DOCUMENTS

| | | | |
|---|---|---|---|
| WO | 0070148 | A1 | 11/2000 |
| WO | 03006298 | A1 | 1/2003 |
| WO | 2004009422 | A1 | 1/2004 |

* cited by examiner

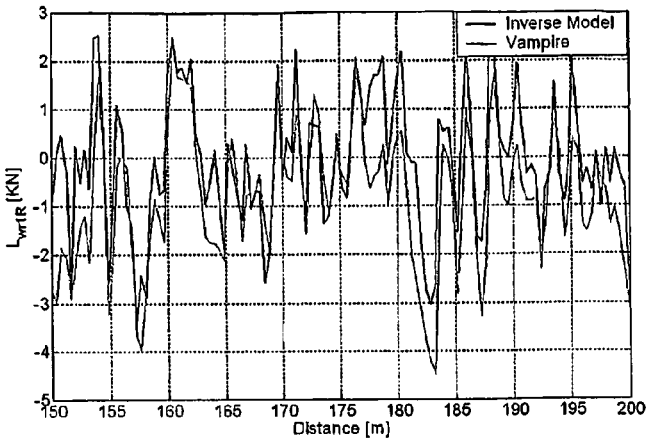
Figure 9. Lateral wheel-rail contact force for Vertical PSD class 5 with loaded wagon
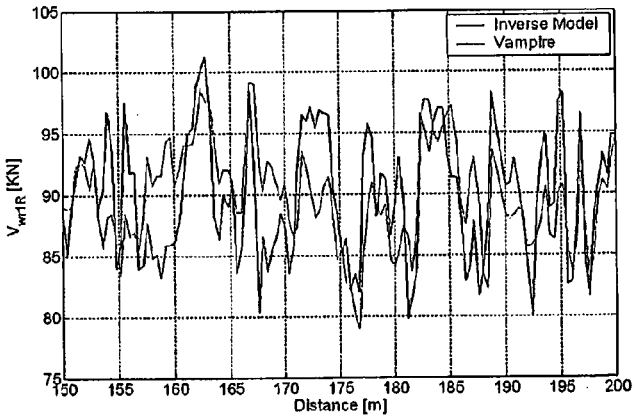
Figure 10. Vertical wheel-rail contact force for PSD class 5 with loaded wagon

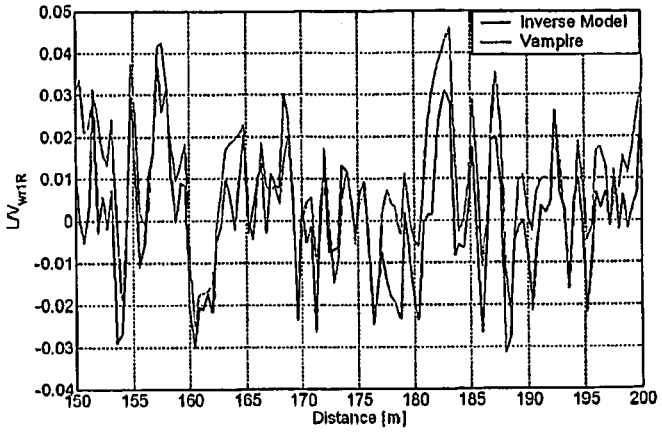
Figure 11. Ratio of L/V for PSD class 5 with loaded wagon
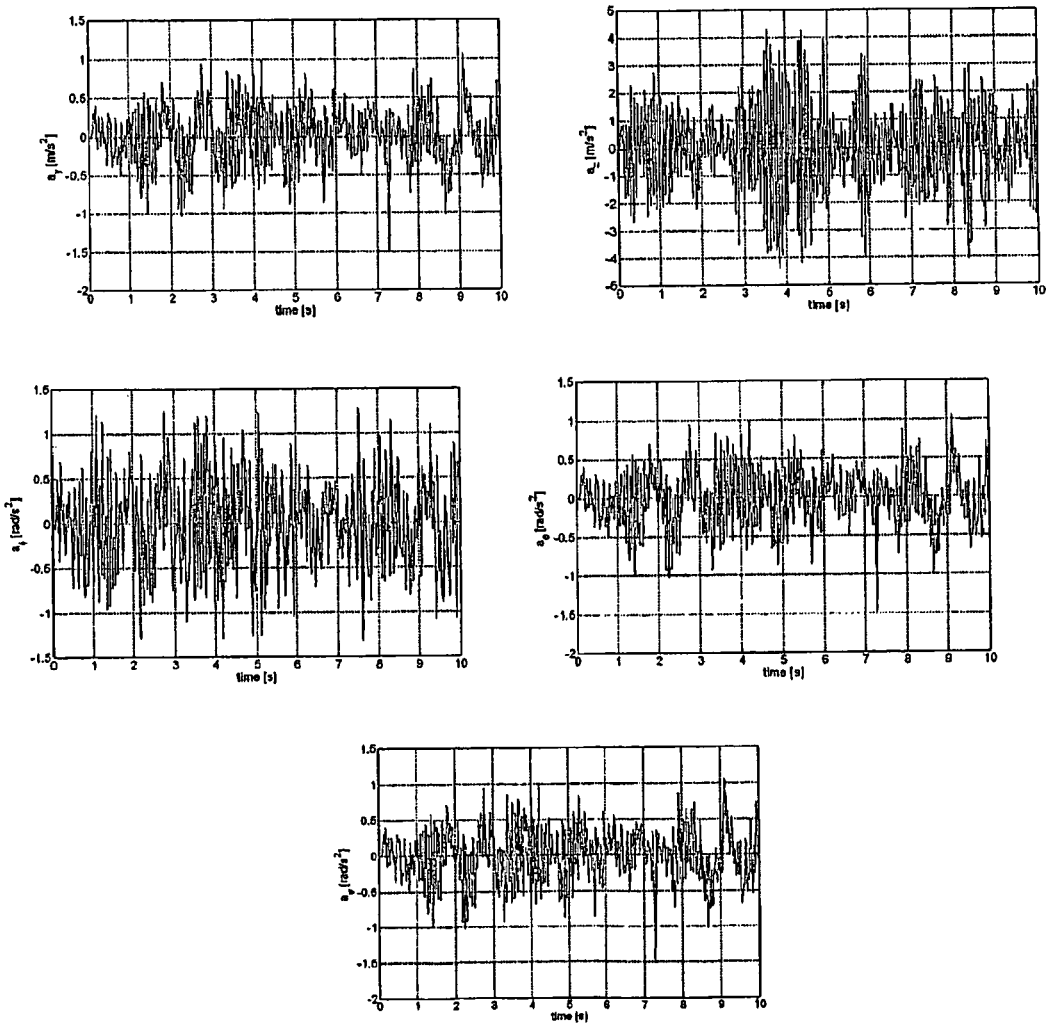
Figure 12. Measured wagon body accelerations 14.
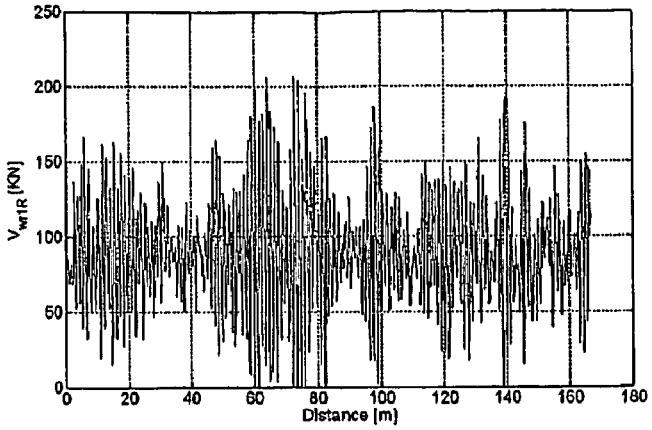
Figure 13. Estimated vertical wheel force for measured acceleration
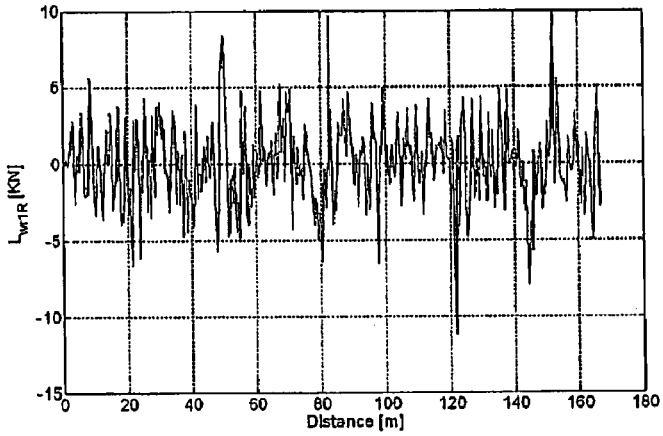
Figure 14. Estimated lateral wheel force for measured acceleration
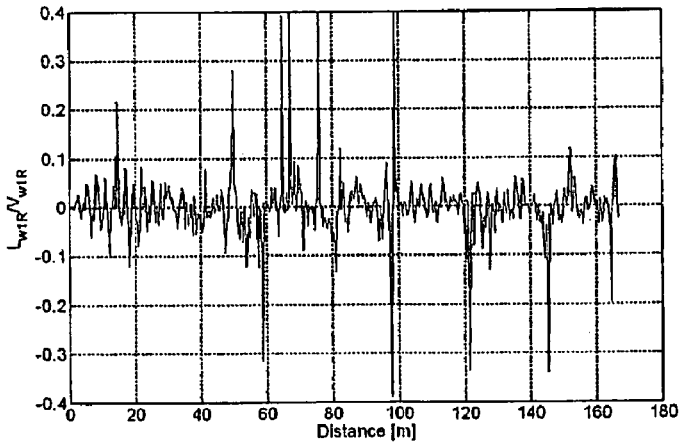
Figure 15. Estimated ratio of L/V for measured acceleration

ESTIMATION OF WHEEL RAIL INTERACTION FORCES

FIELD OF THE INVENTION

This invention relates to a method and apparatus for estimating interactions between the wheels of a railway vehicle and the rail tracks, in particular but not only to estimation of the contact forces caused by irregularities in the surfaces of the rails.

BACKGROUND TO THE INVENTION

Information relating to wheel-rail interactions of rail vehicles such as wagons can be used in various ways, such as to provide an indication of possible derailment of the vehicles, and analysis of wheel or track damage. However, it is generally not possible to make a direct measurement of the interaction forces between the wheels of a railway vehicle and rails on which the wheels are moving, because the contact locations are inaccessible.

A range of commercial products for indirectly determining these interactions are available, such as the software packages known as VAMPIRE®, ADAMS/Rail®, and NUCARS®. The products involve a forward dynamic model of the vehicle-rail system in which irregularities in the track are measured first and the contact forces are then predicted using the running speed and known properties of the vehicle. However, there are a number of disadvantages in the overall technique, including the cost of the measurement systems which provide the track data and their difficulty of maintenance for normal rolling stock.

A range of simulation packages which use (Artificial Neural Network) ANN modelling for rail vehicles and interaction forces are also available. These also require track geometry and running speed as input in order to calculate interactions between the wheels and the rails. An ANN model requires sufficient field test data to develop a simulation model for each vehicle type. The process is therefore costly and retains a limitation in that it depends on the most recent track data for daily evaluations of vehicle performance.

There has not yet been a successful product which is able to calculate wheel-rail forces in real-time, based on parameters of the vehicle and measurements of the motion of the vehicle. This is a non-linear inverse problem involving friction and damping in the wheelsets.

SUMMARY OF THE INVENTION

It is an object of the invention to provide improved systems for estimation of contact forces between the wheels of a rail vehicle and the rails, or at least to provide an alternative to existing systems.

In one aspect the invention may therefore broadly be said to reside in a method of estimating contact forces between the wheels of a railway wagon and a rail track along which the wagon is moving, including: determining accelerations of the body of the wagon, calculating forces on the side frames of the wagon based on the accelerations of the body and predetermined parameters of the body, calculating forces on the wheels of the wagon based on the accelerations of the body and predetermined parameters of the body, and calculating contact forces between the wheels and the rails based on the forces calculated for the side frames and the wheels.

Preferably the accelerations of the wagon body are determined by placing motion sensors at locations on the body of the wagon that are spaced from the centre of mass of the wagon, and receiving data from the sensors at a processor which is also located on the wagon. The data received from the motion sensors is transformed into accelerations which represent lateral, vertical, pitch, roll and yaw movements of the body about the centre of mass of the wagon. The calculations are based on a model which includes approximations for the body, the side frames and wheelsets of the wagon with Hertzian spring and viscous damping parameters.

In another aspect the invention also resides in apparatus for estimating contact forces between the wheels of a railway wagon and a rail track, including: a set of motion sensors for placement at locations relative to the centre of mass of the wagon, and a processor which receives data from the sensors and contains computer program code which: calculates forces on the side frames of the wagon based on the accelerations of the body and predetermined parameters of the body, calculates forces on the wheels of the wagon based on the forces between the wheels and the rails based on the forces calculated for the side frames and the wheels. A transmitter for sending data relating to the contact forces from the processor to a collection site may also be included.

The invention also resides in any alternative combination of features which are indicated in this specification. All equivalents of these features are considered to be included whether or not they are mentioned explicitly.

LIST OF FIGURES

Figure 2:
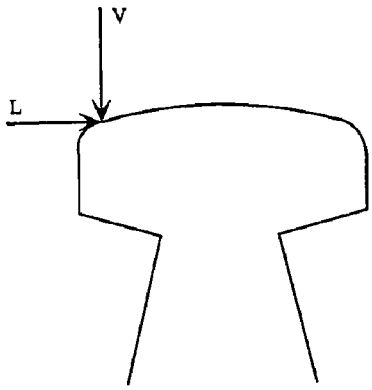
Figure 3:
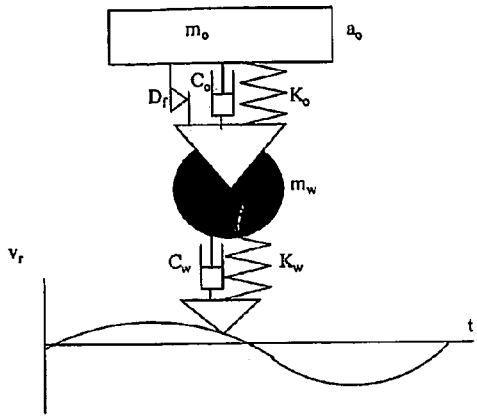
Figure 4:
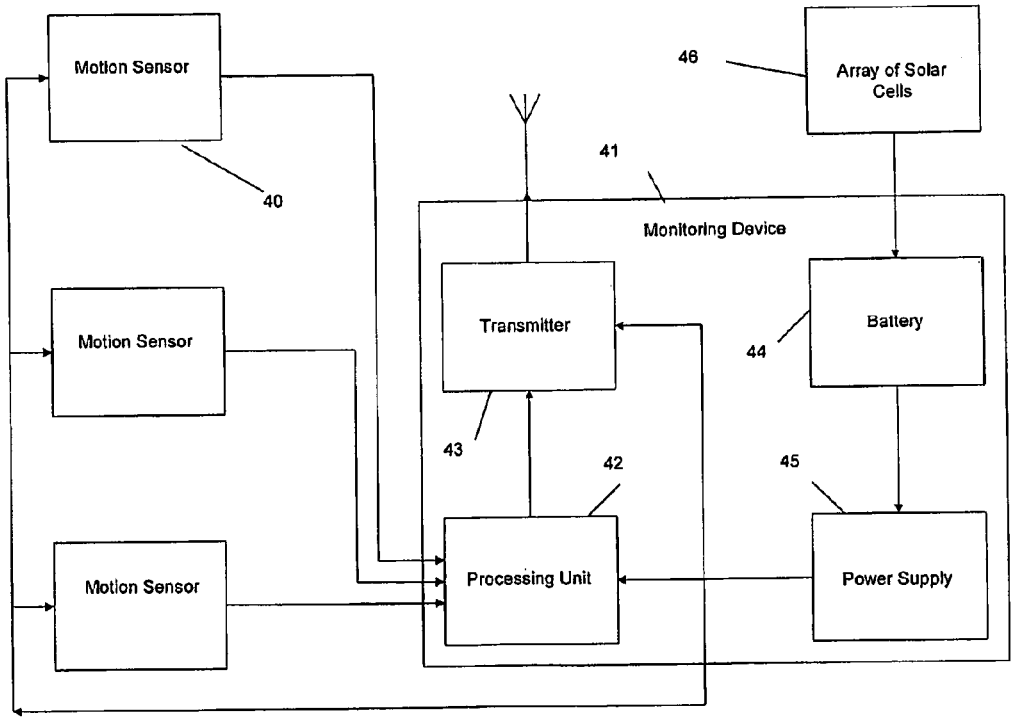
Figure 5:
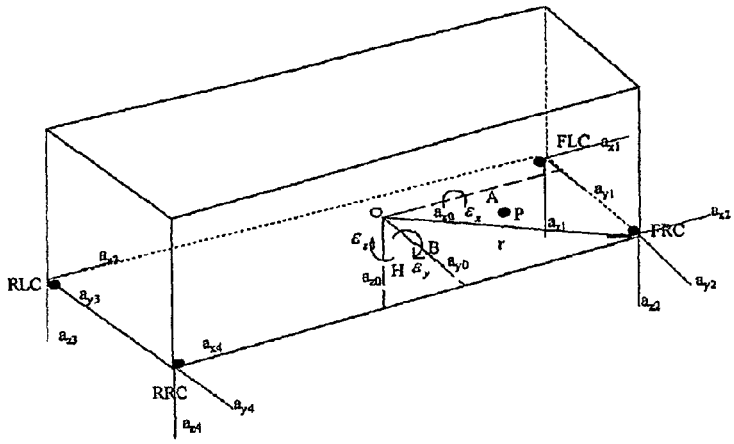
Figure 6:
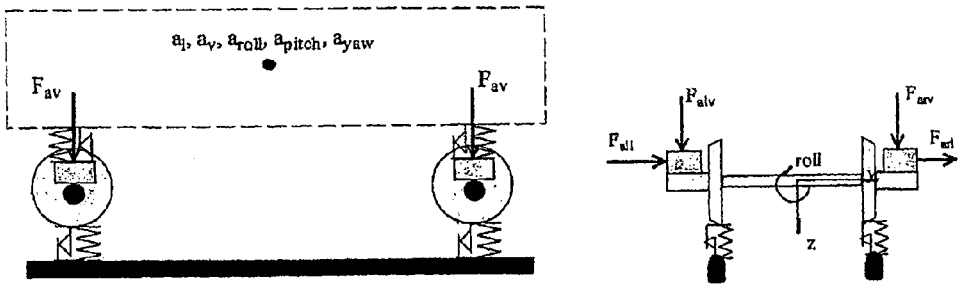
Figure 7:
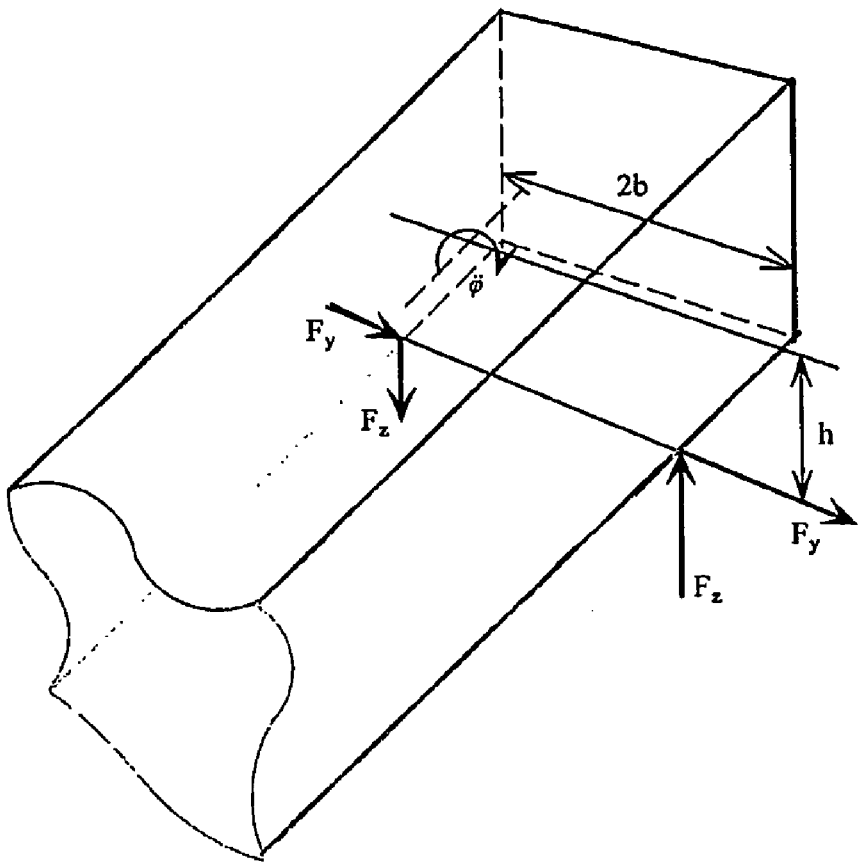
Figure 8:
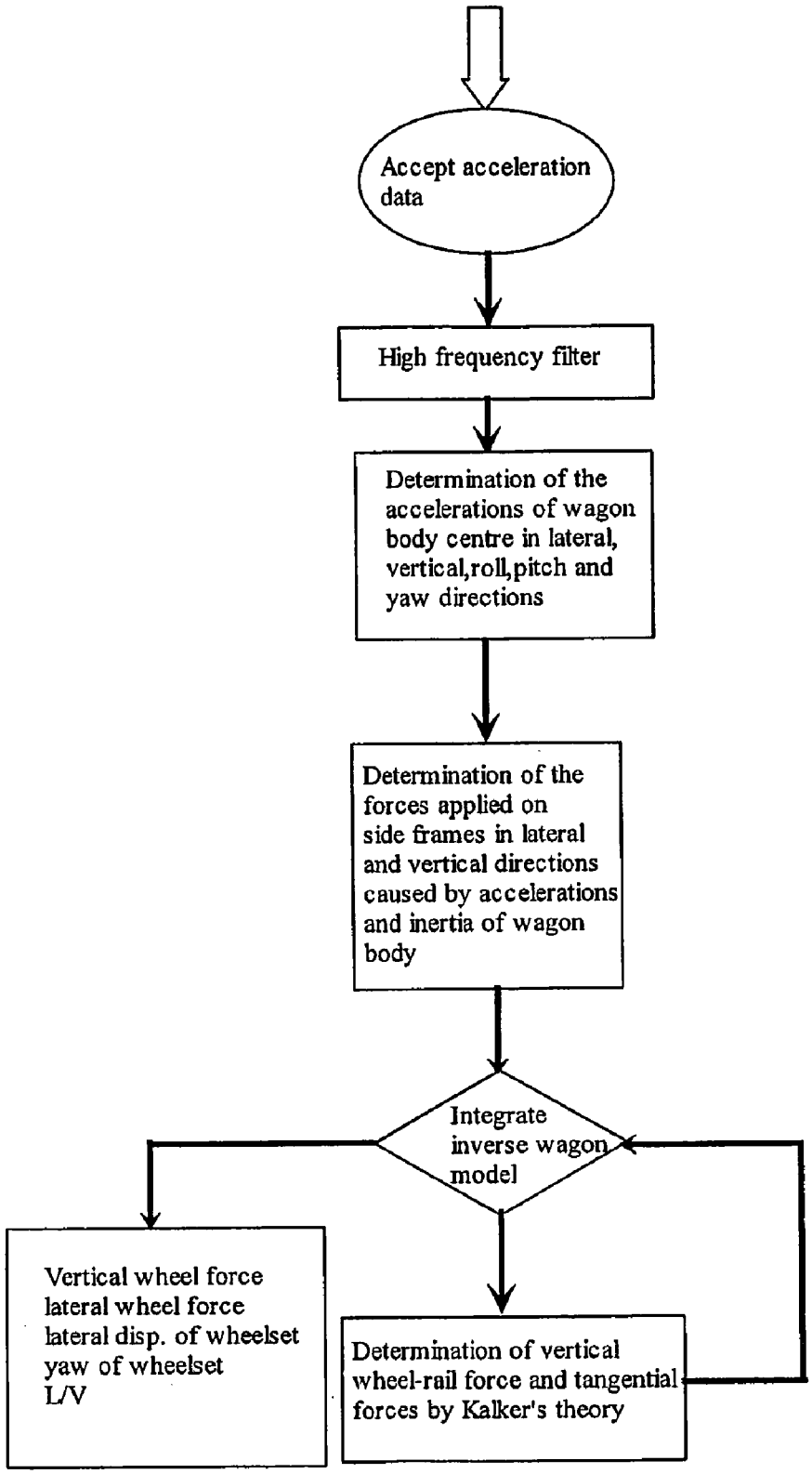

Preferred embodiments of the invention will be described with respect to the accompanying drawings, of which:

FIG. 1 schematically shows a railway wagon,

FIG. 2 indicates wheel-rail forces which may arise on a rail,

FIG. 3 is a simplified model of a wheelset on the wagon or other vehicle,

FIG. 4 indicates equipment which may be used to monitor motion of the wagon, FIG. 5 indicates the characteristics of motion sensors in the equipment, FIG. 6 indicates an inverse vehicle dynamic model of a wagon, FIG. 7 indicates a determination of inertia forces on a wagon body, FIG. 8 outlines operation of program code in the equipment, FIG. 9 shows a typical variation of lateral wheel-rail contact force, FIG. 10 shows a typical variations of vertical wheel-rail contact force, FIG. 11 shows the ratio of lateral to vertical forces in FIGS. 9 and 10, FIG. 12 shows measured wagon body accelerations, FIG. 13 shows estimated vertical wheel force for the measured acceleration, FIG. 14 shows estimated lateral wheel force for the measured acceleration, and FIG. 15 shows the ratio of lateral to vertical forces for the measured accelerations.

DESCRIPTION OF PREFERRED EMBODIMENTS

Referring to these drawings it will be appreciated that the invention can be implemented in various forms for a variety of vehicular systems. These embodiments involve railway wagons and are given by way of example only.

FIG. 1 shows a rail wagon having a body 10 and two bogies 11. In this example each bogie has a pair of parallel side frames 12, each mounted on a vertical suspension unit and carrying a pair of wheels 13. Wheels on a common suspension unit are considered to be a load sharing group. The side frames are joined by bolsters 14. Wheelsets are formed by pairs of wheels on opposite ends of an axle. Each bogie therefore has a pair of wheelsets. It will be appreciated that a wide variety of wagon structures are used in practice.

FIG. 2 indicates lateral and vertical force vectors L, V at the head of a rail. These represent contact forces at the interface between the rail and a wheel and are used to quantify two important criteria of wagon stability. The dynamic vertical force is often expressed as a percentage of its static value thus indicating wheel unloading. The lateral force is often expressed as a ratio in comparison to vertical force in the form of (Lateral Force)/(Vertical Force). This ratio is known as "Nadal's Criteria" or "the derailment index" or "the L/V ratio" and is use to indicate the tendency of the vehicle to derail in wheel climb modes. The force action point varies with the changes of wheel-rail kinematical contact parameters.

FIG. 3 shows how a mathematical-physical model enables the vertical force to be described by a sum of corresponding spring and damping forces. The following analysis involves a simplified 2 Degrees of Freedom (DOF) system consisting of a wheel and the suspended mass and will provide a basic conception for prediction of the vertical wheel rail contact force. A realistic physical model is more complex and has many more DOFs and the wagon body motion is expressed by three translational accelerations and three rotational accelerations.

In this system the acceleration of mass $m_o$ is used to estimate wheel-rail interface force via the following equations.

$$m_o a_o + C_o(\dot{z}_o - \dot{z}_w) + K_o(z_o - z_w) + F_{Df} = 0 \quad (1)$$

$$m_w \ddot{z}_w + C_w(\dot{z}_w - \dot{v}_r) + K_w(z_w - v_r) = -m_o a_o \quad (2)$$

where $a_o$ denotes the acceleration of the mass $m_o$;$\ddot{z}_w$ denotes the acceleration of the mass $m_w$; linear dampers are defined by $C_o$;$C_w$; linear spring stiffnesses are defined by $K_o$;$K_w$; vertical displacements and velocities of the masses $m_o$ and $m_w$ are $\dot{z}_o$;$z_o$ and $\dot{z}_w$;$z_w$ respectively, $v_r$ denotes the vertical track irregularity which is a function of time or distance, and $F_{Df}$ is the non-linear damper (usually friction) that is positioned between masses $m_o$ and $m_w$.

Let $$z_{wr} = z_w - v_r \quad (3)$$

then equation (2) becomes $$m_w \ddot{z}_{wr} + C_w \dot{z}_{wr} + K_w z_{wr} = -m_o a_o \quad (4)$$

Define $$F_{wr} = C_w \dot{z}_{wr} + K_w z_{wr} \quad (5)$$

as wheel rail vertical contact force and needs to be predicted.

The inertial force, $m_o a_o$ and running speed are inputs on the system described in Equation (2). Then the system can be solved numerically to obtain the displacement and velocity, $z_{wr}$,$\dot{z}_{wr}$. To the end with Equation (5) the vertical wheel-rail interface force can be determined. There are several methods to be applied to the estimation of load but they have various limitations for prediction of the wheel rail contact forces.

FIG. 4 shows items of equipment which may be used to monitor the motion of a railway vehicle and perform calculations which lead to estimation of the contact forces. The equipment includes a set of motion sensors 40 such as accelerometers or velocity sensors. These are placed and secured at suitable locations on the wagon body shown in FIG. 1, spaced from the overall centre of mass, typically at the corners of the wagon body. In general there must be three or more sensors located on the body. A monitoring device 41 is also located on the wagon or possibly elsewhere on the train which includes the wagon, and receives data from the sensors, through wired or wireless connections. The device includes processor 42, transmitter/antenna 43 and battery 44. Power supply 45 delivers power from the battery to the processor, transmitter and sensors. The battery is preferably charged by a source on the train such as solar cells 46. All components are constructed to withstand mechanical damage and are sealed against the ingress of dust and water.

FIG. 5 indicates the placement and operation of the motion sensors in more detail. The minimum functionality required in these sensors is two axes measured at each of the three locations. One sensor at each end of the wagon measures lateral and vertical motions to allow vertical, lateral, yaw and pitch modes to be calculated. A third 2 axis motion sensor one end measures vertical and longitudinal motions to allow longitudinal and roll motions to be calculated. More accurate results can be achieved with tri-axle accelerometers in each location. The use of tri-axle accelerometers in each location allows correct calculation of large angle movements and includes implicit averaging for wagon body flexure.

The motion sensors in a prototype are Analog Devices ADXL202/10 dual axis acceleration sensors. The ADXL202/10 measures acceleration in two perpendicular axes and is capable of sensing frequencies from DC to several kilohertz. To secure the full six degrees of freedom for the wagon body motions up to three axis accelerometers are placed at three corners of the wagon body. By the application of a co-ordinate transformation, these signals can be converted into longitudinal, lateral and vertical accelerations as well as pitch roll and yaw. In this preferred embodiment three sensor devices are placed upon the wagon body at locations such that the wagon body motion in six degrees of freedom may be observed. The placement of the motion sensing devices is not unique and a multiplicity of placements may be used to observe the wagon body motion in six degrees of freedom. Changes in placement of the motion sensing devices will cause a change in the mathematical transformation required to determine the accelerations at the wagon body mass centre.

The motion sensing devices may be implemented with devices other than accelerometers. Gyroscopes or angular position sensors or angular rotation sensors may be used and acceleration signals can readily be determined from their outputs by differentiation. The number of motion sensing devices applied to observe the motion of the wagon body in six degrees of freedom may be other than three. The motion sensor outputs are processed by the processing device. In this preferred embodiment the wheel rail interaction force prediction device is implemented using a Rabbit 3000 processor operating at 40 MHz with has 256 KB of RAM. The wheel rail force indications are transmitted from the device by radio transmitter.

FIG. 6 shows a physical model used to develop a system of equations that are solved by the prototype device to estimate wheel rail interaction forces. The model preferably has these characteristics:

- The bolsters are assumed to be fixed to the wagon body;
- The pitch of a side frame is neglected so the predicted motion of the two wheelsets on the same bogie is considered to be the same;
- The side frame is assumed to contact the wheelset without suspension so the mass of side frame is considered a point mass on the adapter;

Hertzian stiffness is used to simulate wheel rail normal contact.

Assuming a wagon with three-piece bogies, (as is widely used in Australian freight and heavy haulage), the model shown in FIG. 6 is a simplified wagon with masses and connections lumped together as follows.

The wagon body mass includes wagon body and bolster masses;

The wheelset mass includes the unsprung mass of a three piece bogie: i.e. two wheelsets and two sideframes.

The primary suspension is equivalent to the three piece bogie secondary suspension.

The model in FIG. 6 has 13 Degrees of Freedom as listed in Table 1 and it should be noted that the model can readily be adapted and adjusted to many other bogie designs.

TABLE 1

Physical Model Degrees of Freedom

| Component | DOF x | DOF y | DOF z | DOF ϕ | DOF χ | DOF ψ | No. of Items | No. of DOF |
|---|---|---|---|---|---|---|---|---|
| Wagon Body | | x | x | x | x | x | 1 | 5 |
| Wheel Set | | x | x | x | | x | 2 | 8 |
| Total DOF | | | | | | | | 13 |

x - longit.
y - lateral
z - vertical
ϕ - roll
χ - pitch
ψ - yaw

In application, the translation and angular accelerations of the wagon body can be measured at one point different from mass centre at point P (see FIG. 5), in this case, the mass centre accelerations of the wagon body in lateral and vertical can be obtained by relative motion relationships below.

$$\begin{bmatrix} a_{x0} \\ a_{y0} \\ a_{z0} \end{bmatrix} = \begin{bmatrix} a_x \\ a_y \\ a_z \end{bmatrix} - \begin{bmatrix} 0 & -\alpha_z & \alpha_y \\ \alpha_z & 0 & -\alpha_x \\ -\alpha_y & \alpha_x & 0 \end{bmatrix} \begin{bmatrix} A \\ B \\ H \end{bmatrix} \tag{6}$$

where $a_{xo};a_{yo};a_{zo}$ denotes the acceleration of the mass centre at point O in the x, y and z directions, $a_x;a_y;a_z$ denotes the accelerations measured at point P, A, B, H denote the distance between the mass centre to the measured point P in longitudinal, lateral and vertical directions. The factors, $a_x;a_y;a_z$ are the angular accelerations about the x, y and z axis. The angular accelerations remain unchanged.

Alternatively, only translation accelerations of wagon body in longitudinal, lateral and vertical directions are measured at three corners of a wagon body (see FIGS. 1 and 5) then the mass centre angular accelerations of the wagon body can be described as $$\alpha_x = \frac{a_{z3} - a_{z2}}{2B} \tag{7}$$

$$\alpha_y = \frac{a_{z3} - a_{z1}}{2A}$$

$$\alpha_z = \frac{a_{y1} - a_{y2}}{2A}$$

and the translation accelerations are $$a_{x0} = \frac{a_{x2} + a_{x3}}{2} - H\frac{a_{z3} - a_{z1}}{2A} \tag{8}$$

$$a_{y0} = \frac{a_{y1} + a_{y3}}{2} + H\frac{a_{z3} - a_{z2}}{2B}$$

$$a_{z0} = \frac{a_{z1} + a_{z2}}{2}.$$

The use of equations (6), (7) and (8) allow for considerable flexibility in the where motion sensors can be located on the wagon body. Once mounted the position of the motion sensors is used to configure the inverse model to give correct results for that particular wagon.

The wheel/rail vertical contact forces are determined by the Hertzian spring between wheel and rail. Normal wheel/rail contact force is determined by the vertical force and creepages and the creep forces are used to determine the lateral and longitudinal creep force component. If the lateral oscillations of the wheel set exceed the flange clearance, δ, there is also contact between the wheel flange and the rail. This results in a sudden restoring force, $F_T$, which is called the flange force. A phenomenological description of this force is provided by a stiff linear spring with a dead band, $$F_T(y) = \begin{cases} k_0(y-\delta), & \delta < y, \\ 0, & -\delta \le y \le \delta, \\ k_0(y+\delta), & y < -\delta \end{cases} \tag{9}$$

where y denotes the lateral displacement of the wheelset, $k_o$ denotes impact stiffness between flange and rail; δ denotes the lateral distance between the rail gauge face and the flange when the wheelset is centred. Since the accelerations of wagon body in lateral, vertical, roll, pitch and way directions are known the independent variables of the system reduce to 8. The inverse vehicle model can be described mathematically as:

$$[M]\ddot{X}_{wr}+[K]X_{wr}+[C]\ddot{X}_{wr}=F_w+F_a+F_n+F_1 \tag{10}$$

where [M] denotes the mass matrix, [K] is the spring stiffness matrix. [C] is the system damping matrix, $F_w$ denotes the weight force vector. $F_a$ is the force vector related both to the inertias and measured accelerations of wagon body, $F_n$,$F_t$ denote vertical and lateral wheel-rail contact forces respectively. The vertical force, $F_n$, is determined by:

$$F_n=[K_{wr}]X_{wr}+[C_{wr}]\dot{X}_{wr} \tag{11}$$

where $[K_{wr}]$ is the wheel-rail stiffness matrix. $[C_{wr}]$ is the wheel-rail damping matrix, $X_{wr}$ are independent variable vectors, consisting of translational and angular displacements and defined by:

$$X_{wr}=[y_{w1},z_{w1},\phi_{w1},\psi_{w1},y_{w3},z_{w3},\phi_{w3},\psi_{w3}]^T. \tag{12}$$

where $y_{w1};z_{w1};\phi_{w1};\psi_{w1}$ denote, respectively, lateral displacement, vertical displacement, roll (angular displacement about the y-axis) and yaw (angular displacement about the z-axis) for the first bogie. Similarly $y_{w3};z_{w3};\phi_{w3};\psi_{w3}$ refers to the second bogie.

For the translation motion the inertia force is calculated by acceleration multiplying wagon body mass, but to the rotation motion, for example, if the roll acceleration of wagon body is known the support forces both in lateral and vertical directions can be determined by the method below (see FIG. 7).

$$F_y = -\frac{\sigma I_x \ddot{\phi}}{2b(1+\sigma^2)},\ F_z = -\frac{I_x \ddot{\phi}}{2b(1+\sigma^2)}, \tag{13}$$

where $$\sigma = \frac{h}{b} = \frac{F_y}{F_z}. \tag{14}$$

b, h stand for the lateral and vertical distances from the force acting point to the mass centre respectively, $\ddot{\phi}$; is the roll angular acceleration, in this case about the x axis, (e.g. roll).

FIG. 8 shows the functional flow of an algorithm for evaluating a wagon model using a monitoring device such as described above. Acceleration data is firstly acquired at a suitable sample rate. The sample rate must be high enough to prevent aliasing as rolling stock vibrations typically include high frequency small amplitude vibrations resulting from track surface and wheel bearing inputs. High frequency acceleration components that are of no significance to wagon dynamics must firstly be filtered from the acceleration data. On freight wagons, signals above 20 Hz have little effect on wagon dynamics. Accelerations of the wagon body are then determined using the acceleration data from the motion sensors and known measurements of the motion sensor positions relative to the wagon body centre of mass. The forces applied to the bogies are then calculated using the measured accelerations and the known mass and inertia of the wagon body. An inverse model is then used to calculated vertical and lateral forces applied at the bogie. These results are used to infer wheel unloading and L/V ratio. As bogie pitch and bogie yaw cannot be derived from motion sensor data of the car body alone, the values calculated represent average wheel unloading and L/V taken across the two wheel-rail contacts on each side of the bogie (i.e. across a sideframe.). The theories of Kalker can be found in Garg, V. K. and Dukkipati, Roa V. 1984, Dynamics of Railway Vehicle Systems (Academic Press), for example.

FIGS. 9 to 15 show results from calculations made using the inverse model described above. FIGS. 9, 10, 11 are comparisons of the model data with standard simulations from the VAMPIRE package. VAMPIRE utilises a traditional forward model and all track geometry data must be supplied. The wagon response data obtained from the VAMPIRE model (simulating the data that would be obtained from the motion sensors in this embodiment) was recorded and then used as input to the inverse model. The inverse model was then used to produced lateral force data (FIG. 9) vertical force data (FIG. 10) and L/V data (FIG. 11). In all three cases there is sufficient agreement between the inverse model output and the VAMPIRE output to justify the use of the inverse model as a field device for indicating characteristics such as poor track-wagon interaction, poor track surface and derailment.

FIG. 12 shows the filtered accelerometer inputs measured by the monitoring device on track tests. FIGS. 13, 14, 15 show calculations of vertical, lateral and L/V over 160 m of track using measured accelerometer data from the motion sensors.

Many variations of the invention are possible within the scope of the following claims.

The invention claimed is:

1. A method of estimating contact forces between the wheels of a railway wagon and a rail track along which the wagon is moving, including:

determining accelerations of the body of the wagon, calculating forces on the side frames of the wagon based on the accelerations of the body and predetermined parameters of the body, the calculating of the forces on the side frames of the wagon being performed by a configured monitoring device, calculating forces on the wheels of the wagon based on the accelerations of the body and predetermined parameters of the body, the calculating of the forces on the wheels of the wagon being performed by the configured monitoring device, and calculating contact forces between the wheels and the rails based on the forces calculated for the side frames and the wheels, the calculating of the contact forces between the wheels and the rails being performed by the configured monitoring device, the contact forces arise from the surfaces of the rails and are averaged over the wheels which are associated with each vehicular suspension unit.

2. The method according to claim 1 wherein determining accelerations of the wagon body includes:

placing motion sensors at locations on the body of the wagon that are spaced from the centre of mass of the wagon, and receiving data from the sensors at a processor which is also located on the wagon.

3. A method according to claim 2 wherein determining accelerations of the wagon body includes:

transforming data received from the motion sensors into accelerations representing lateral, vertical, pitch, roll and yaw movements of the body about the centre of mass of the wagon.

4. The method according to claim 1 wherein the calculations are based on a model which includes approximations for the body, the side frames and wheelsets of the wagon with Hertzian spring and viscous damping parameters.

5. The method according to claim 1 wherein the monitoring device comprises a processor that includes computer program code stored in computable readable medium, when executed to perform the calculation of the contact forces between the wheels and the rails.

6. A method of estimating contact forces between the wheels of a railway wagon and a rail track along which the wagon is moving based on a model of a body and bogies of the wagon in which a sprung body mass is supported by unsprung wheel masses, the method comprising:

determining accelerations of the body of the wagon;

calculating accelerations of the sprung body mass based on the accelerations of the body and a first set of parameters of the body, the calculating of the accelerations of the sprung body mass being performed by a configured monitoring device;

calculating forces from the sprung body mass on the unsprung wheel masses based on the accelerations of the sprung body mass and a second set of parameters of the body, the calculating of the forces from the sprung body mass on the unsprung wheel masses being performed by the configured monitoring device;

calculating of the contact forces between the unsprung wheel masses and the rail track based on the forces from the sprung body mass and a third set of parameters of the model, the calculating of the contact forces between the unsprung wheel masses and the rail track being performed by the configured monitoring device; and estimating the contact forces between the wheels and the rails based on the contact forces between the unsprung wheel masses and the rail track, the estimating of the contact forces between the wheels and the rails being performed by the configured monitoring device.

7. The method according to claim 6 wherein the sprung body mass includes the body of the wagon and bolsters of the bogies.

8. The method according to claim 6 wherein each unsprung wheel mass includes wheelsets and side frames of one of the bogies.

9. The method according to claim 8 wherein pitch rotations of the side frames of a bogie are neglected.

10. The method according to claim 6 wherein the accelerations of the sprung body mass relate to lateral, vertical, pitch, roll and yaw movements of the body about the center of mass of the wagon.

11. An apparatus for estimating contact forces between the wheels of a railway wagon and a rail track, comprising:

a set of motion sensors for placement at locations relative to the center of mass of the wagon; and a monitoring device configured to receive data from the sensors and estimate contact forces between the wheels of the railway wagon and the rail track by:

providing a model of the body and the bogies of the wagon in which a sprung body mass is supported by unsprung wheel masses, determining accelerations of the body of the wagon, calculating accelerations of the sprung body mass based on the accelerations of the body and a first set of parameters of the body, calculating forces from the sprung body mass on the unsprung wheel masses based on the accelerations of the sprung body mass and a second set of parameters of the body, calculating contact forces between the unsprung wheel masses and the rail track based on the forces from the sprung body mass and a third set of parameters of the model, and estimating the contact forces between the wheels and the rails based on the contact forces between the unsprung wheel masses and the rail track.

12. The apparatus according to claim 11 wherein the sprung body mass includes the body of the wagon and bolsters of the bogies.

13. The apparatus according to claim 11 wherein each unsprung wheel mass includes wheelsets and side frames of one of the bogies.

14. The apparatus according to claim 13 wherein pitch rotations of the side frames of a bogie are neglected.

* * * * *